US005585607A

United States Patent [19]

Kato et al.

[11] Patent Number: 5,585,607

[45] Date of Patent: Dec. 17, 1996

[54] COLLISION DETECTING APPARATUS

[75] Inventors: Minoru Kato, Ichinomiya; Takaaki Ori, Nagoya, both of Japan

[73] Assignee: Nippondenso Co., Ltd., Kariya, Japan

[21] Appl. No.: 266,474

[22] Filed: Jun. 27, 1994

[30] Foreign Application Priority Data

Jul. 1, 1993 [JP] Japan ..... 5-163464

[51] Int. Cl.[6] ..... H01H 35/14

[52] U.S. Cl. ..... 200/61.53

[58] Field of Search ..... 200/61.45 R, 61.45 M

[56] References Cited

U.S. PATENT DOCUMENTS

| | | | |
|---|---|---|---|
| 3,967,079 | 6/1976 | Sasaya et al. | 200/61.45 R |
| 4,184,057 | 1/1980 | Kumita et al. | 200/61.45 R |
| 5,306,883 | 4/1994 | Manandhar et al. | 200/61.53 |

FOREIGN PATENT DOCUMENTS

| | | | |
|---|---|---|---|
| 3274464 | 12/1991 | Japan | G01P 15/02 |
| 4154762 | 9/1992 | Japan | G01P 15/00 |
| 4257748 | 9/1992 | Japan | B60R 21/32 |
| 541147 | 2/1993 | Japan | H01H 35/14 |

*Primary Examiner*—Kristine L. Kincaid
*Assistant Examiner*—Michael A. Friedhofer
*Attorney, Agent, or Firm*—Cushman, Darby & Cushman

[57] ABSTRACT

A vehicle collision detecting apparatus is provided which includes a casing having an opening, a base support member fitted into the opening of the casing to retain a movable contact and a stationary contact, a mass member biased by a spring in a first direction along a given path of travel defined in the casing to urge the movable contact into constant disengagement from the stationary contact, and a stopper member formed on the base support member to restrict movement of the mass member in the first direction urged by the spring to hold the movable contact at a given contact gap away from the stationary contact. The mass member is responsive to acceleration caused by impact acting on the apparatus to move in a second direction opposite the first direction against a spring force exerted by the spring to engage the movable contact with the stationary contact to provide a signal indicative of occurrence of a vehicle collision.

14 Claims, 4 Drawing Sheets

COLLISION DETECTING APPARATUS

BACKGROUND OF THE INVENTION

1. Technical Field of the Invention

The present invention relates generally to a collision detecting apparatus which may be employed to detect an accidental vehicle collision for activating an automotive airbag safety unit. More particularly, the invention is directed to an improved structure of a collision detecting apparatus designed to provide for ease of assembly.

2. Background Art

Japanese Patent First Publication No. 3-274464 discloses a conventional collision detecting unit for automotive vehicles. This unit includes generally first and second assemblies. The first assembly includes a casing, a mass member, a main spring for urging the mass member in a given direction within the casing, and a stopper for restricting the movement of the mass member against the spring force of the main spring. The second assembly includes a movable contact, a casing having disposed therein a sub-spring to bias the movable contact onto the mass member of the first assembly to form a preselected contact gap to stationary contacts. Building the second assembly into the first assembly is accomplished by inserting a flange of the casing of the second assembly into an opening of the casing of the first assembly and thermally crimping a peripheral thin-walled edge of the opening.

However, since in such a structure of the collision detecting unit, the first and second assemblies must be combined after each having been assembled completely, assembling processes become complex, requiring more critical tolerances of the respective parts of the unit.

SUMMARY OF THE INVENTION

It is therefore a principal object of the present invention to avoid the disadvantages of the prior art.

It is another object of the present invention to provide an easy-to-assemble structure of a collision detecting apparatus which may be employed for activating an automotive airbag safety unit.

According to one aspect of the present invention, there is provided a collision detecting apparatus which comprises a spring, a mass member biased by the spring in a given direction, the mass member receiving acceleration generated upon occurrence of a vehicle collision to move against a spring force of the spring, a casing having disposed therein the mass member and the spring, the casing having a stopper member formed thereon for restricting movement of the mass member in the given direction biased by the spring, a stationary contact member made of a single member, the stationary contact member having a stationary contact formed on its end, the other end thereof extending outside the casing, and a movable contact member made of a single member, the movable contact member having a movable contact formed on its end and the other end thereof extending outside the casing, the movable contact member being held at a given contact gap away from the stationary contact member by the mass member in engagement with the stopper member.

In the preferred mode, the movable contact member is made of an elastic member. When the mass member moves against the spring force of the spring, the movable contact contacts the stationary contact by virtue of elasticity of the movable contact member. Additionally, the movable contact member and the stationary contact member are made of a conductive member.

The other ends of the movable contact member and the stationary contact member extending outside the casing are bifurcated as external connections, respectively. A monitor resistance is arranged between one of the external connections of the movable contact member and one of the external connections of the stationary contact member to determine whether wire-breakage has occurred or not in an electric circuit line extending through the movable contact member and the stationary contact member in the casing.

The movable contact member and the stationary contact member are bifurcated at least inside the casing to form a plurality of movable contacts and a plurality of stationary contacts thereon, respectively. When the mass member moves against the spring force of the spring, the movable contacts engage the stationary contacts.

A bar member may be further arranged which has both ends thereof retained by the casing to define a given path of travel along which the mass member moves in response to the acceleration caused by the vehicle collision.

The mass member is held between the stopper member and an inner surface of the casing on which the stopper member is formed in engagement with the stopper member.

According to another aspect of the invention, there is provided a collision detecting apparatus which comprises a spring, a mass member biased by the spring in a given direction, the mass member receiving acceleration generated upon occurrence of a vehicle collision to move against a spring force of the spring, a casing having disposed therein the mass member and the spring, the casing having a stopper member formed thereon for restricting movement of the mass member in the given direction biased by the spring, a movable contact member, made of an elastic member having a preselected degree of elasticity, having a movable contact formed on its end and the other end thereof extending outside the casing, the movable contact member including a portion continuing the movable contact which traverses a contact surface of the mass member with the stopper member and being fixed on the casing so as to have the movable contact project outside the contact surface of the mass member, and a stationary contact member having a stationary contact formed on its end and the other end thereof extending outside the casing, the stationary contact member being retained by the casing so as to have the stationary contact disposed at a location where when the mass member moves, the stationary contact engages the movable contact. When the mass member moves, the movable contact engages the stationary contact with the aid of elasticity of the movable contact member.

According to a further aspect of the invention, there is provided a collision detecting apparatus which comprises a casing having an opening, a base support member fitted into the opening of the casing to retain a movable contact and a stationary contact within the casing, a spring disposed in the casing, a mass member, having a preselected mass, arranged in the casing to be biased by the spring in a first direction along a given path of travel defined in the casing to urge the movable contact into disengagement from the stationary contact, the mass member being responsive to acceleration, caused by impact acting on the apparatus, greater than a preselected level to move in a second direction opposite the first direction along the given path of travel against a spring force exerted by the spring to engage the movable contact with the stationary contact to provide a signal, and a stopper member formed on the base support member to restrict movement of the mass member in the first direction urged by the spring to hold the movable contact at a given contact gap away from the stationary contact.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings.

DESCRIPTION OF THE PREFERRED EMBODIMENT

Figure 1:
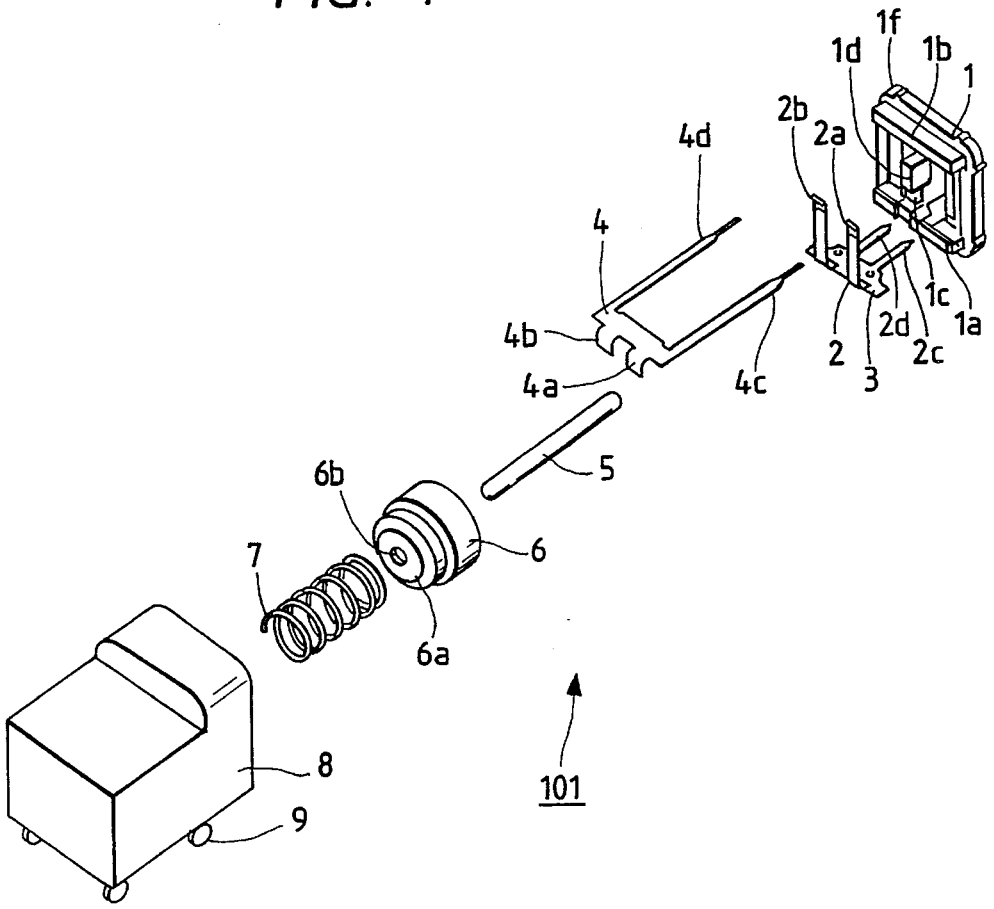
FIG. 1 is an exploded perspective view which shows a structure of a collision detecting apparatus according to the present invention.

Referring now to the drawings, wherein like numbers refer to like parts in several views, particularly to FIG. 1, there is shown a collision detecting unit 101 which may be employed in an airbag safety system for an automotive vehicle.

The collision detecting unit 101 includes generally a cylindrical mass member 6 having a preselected mass, a box-like casing 8, and a base support member 1. On the base support member 1, a movable contact member 2 and a stationary contact member 4 are retained away from each other at a given contact gap. The mass member 6 is arranged in the casing 8 slidably upon acceleration acting on the unit 101 caused by a vehicle collision to urge the movable contact member 2 into engagement with the stationary contact member 4 so that it provides an airbag starting signal to activate the airbag safety system incorporated in the vehicle.

The base support member 1 is made of a resin material, and serves as a cover for the casing 8. The base support member 1 has openings 1*a* and 1*b* through which terminals 2*c* and 2*d* of the movable contact member 2 and terminals 4*c* and 4*d* of the stationary contact member 4 project outward, respectively for electric connection with an external device. On the central portion of the base support member 1, bosses 1*c* and 1*d* are formed. The boss 1*c* has a recessed portion into which an end of a shaft 5 is press-fitted for defining a given path of travel along which the mass member 6 moves slidably in response to impact upon occurrence of a vehicle collision. The boss 1*d* serves as a stopper for holding the mass member 6 biased by a coil spring 7 so as to disengage the movable contact member 2 from the stationary contact member 4 against elasticity of the movable contact member 2.

Figure 2:
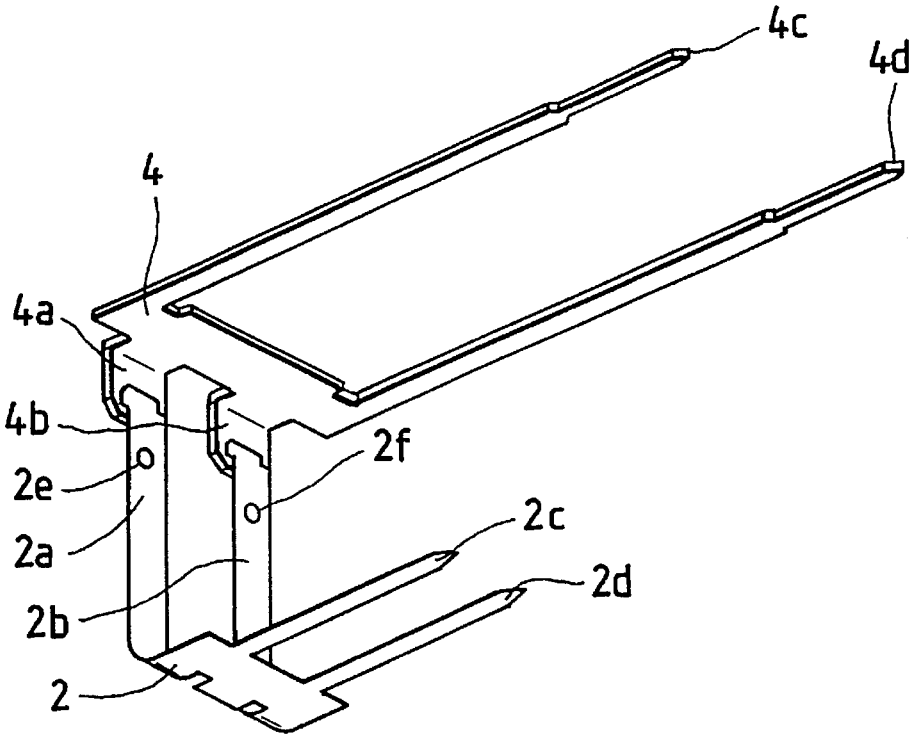
FIG. 2 is a perspective view which shows a movable contact and a stationary contact of a collision detecting apparatus.

The movable contact member 2 is formed by pressing a 0.1 mm-thick single spring metal plate (i.e., an elastic member) so as to have the terminals 2*c* and 2*d* and contacts 2*a* and 2*b* formed integrally with each other. The contacts 2*a* and 2*b* extend from a base portion of the movable contact member 2 in parallel to an inner surface of the base support member 1. The base portion is arranged perpendicular to the contacts 2*a* and 2*b*. On the contacts 2*a* and 2*b*, convex portions 2*e* and 2*f*, as shown in FIG. 2, are formed to securely receive force exerted by the mass member 6 when biased by the spring 7 into constant engagement with the contacts 2*a* and 2*b*. Reinforcing plates 3 are welded or caulked on portions of the contacts 2*c* and 2*d* inserted into the openings 1*a* of the base support member 1 for preventing deformation during assembly.

The stationary contact member 4 is pressed using a single conductive plate to form contacts 4*a* and 4*b* integrally with the terminals 4*c* and 4*d*. The contacts 4*a* and 4*b* are so arranged in the casing 8 as to engage the contacts 2*a* and 2*b* of the movable contact member 2, respectively when the mass member 6 is displaced away from the movable contact member 2 to close an electric circuit. The stationary contact member 4 is press-fitted through the terminals 4*c* and 4*d* into the openings 1*b* of the base support member 1.

With the above arrangements, only one of the contacts 4*a* and 4*b* may function sufficiently as a switching element, however, the two contacts 4*a* and 4*b* are provided in this embodiment for enhancing reliability of electrical contact.

The mass member 6 is arranged, as explained above, slidably on the shaft 5 within the casing 8, and is made of a cylindrical member having a disc portion 6*a* formed on its end for retaining the coil spring 7 between same and art inner wall of the casing 8. The other end of the mass member 6 is urged by a spring force of the coil spring 7 into constant engagement with the movable contact member 2 to push the contacts 2*a* and 2*b* away from the stationary contacts 4*a* and 4*b* of the stationary contact member 4 against elasticity of the movable contact member 2. Additionally, a through hole 6*b* which has a diameter slightly greater than that of the shaft 5 is formed in the central portion of the mass member 6.

The coil spring 7 has a preselected spring constant K1 which urges the mass member 6 onto the stopper 1*d* of the base support member 1 while allowing the mass member 6 to move against the spring force when impact (i.e., acceleration) caused by the vehicle collision acts on the collision detecting unit 101. It is advisable that the spring constant K1 of the coil spring 7 be set to a value, more than twice a spring constant K2 of the contacts 2*a* and 2*b*, required for opening the contacts 2*a* and 2*b* of the movable contact member 2 so as to increase a difference between the spring constants K1 and K2 for reducing the influence of the spring force of the contacts 2*a* and 2*b* of the movable contact member 2.

Figure 3:
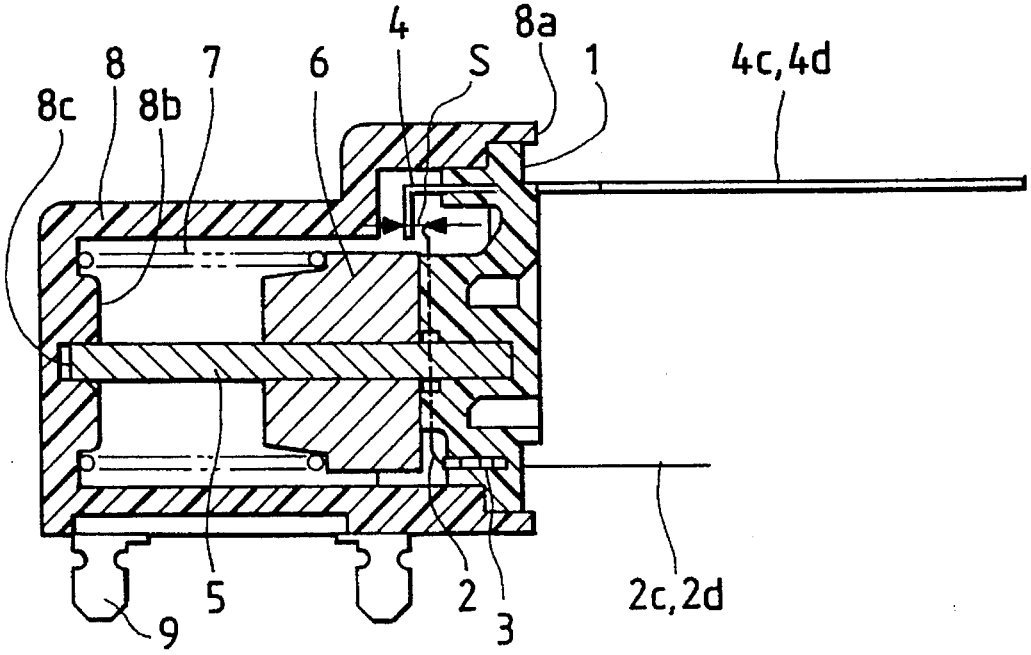
FIG. 3 is a cross-sectional view which shows a collision detecting apparatus.

The casing 8 is made of a resin material and has an opening 8*a* formed in its end into which the base support member 1 is fitted. In addition, on the inner wall of the casing 8, a protrusion, or boss 8*b*, as shown in FIG. 3, is formed for retaining the coil spring 7 between same and the mass member 6. A recessed portion 8*c* is formed in the central portion of the boss 8*b* for bearing an end of the shaft 5. Disposed on an outer wall of the casing 8 are mounting terminals 9 for mounting the collision detecting unit 101 on a printed circuit board of an airbag electronic control unit (not shown).

On a peripheral surface of the base support member 1, a plurality of protrusions 1*f*, as shown in FIG. 1, are formed so that a maximum dimension of the base support member 1 may become slightly greater than a dimension of the opening 8*a* of the casing 8. After all component parts are build into the casing 8, the base support member 1 is press-fitted into the casing 8 against the spring force of the coil spring 7 to hold the coil spring 1 within the casing 8, urging through the mass member 6 the movable contact member 2 into constant disengagement from the stationary contact member 4. An opening end portion of the casing 8 is then thermally crimped to prevent the base support member 1 from working out of the casing 8.

Figure 4:
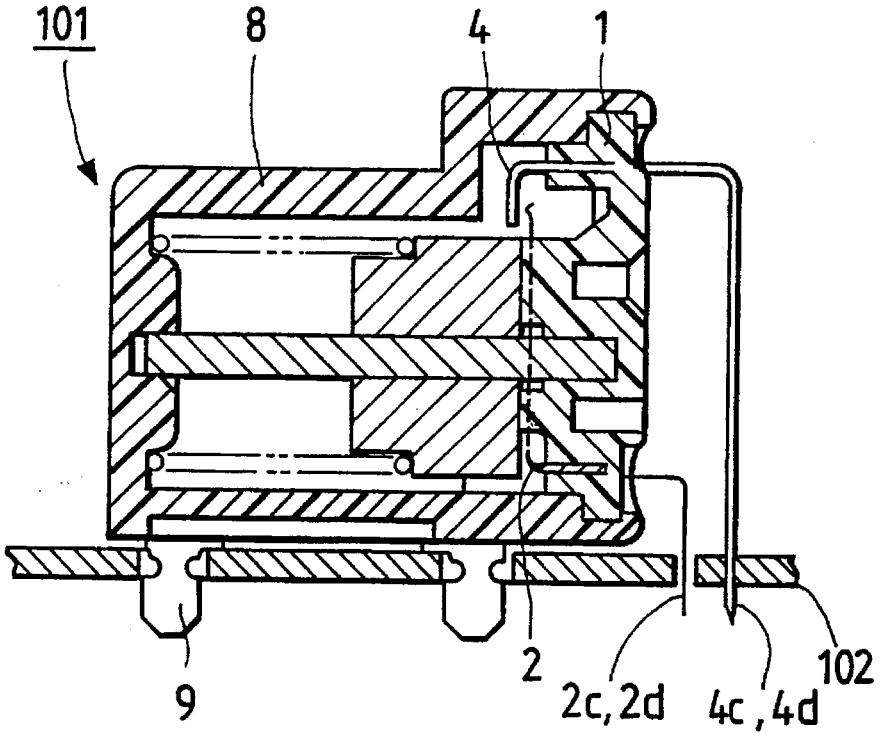
FIG. 4 is a cross-sectional view which shows a collision detecting apparatus mounted on a printed circuit board of an electronic control unit of an airbag safety unit.

FIG. 4 is a cross-sectional view which shows the collision detecting unit 101 installed on a printed circuit board 102 of the airbag electronic control unit. As seen in the drawing, the terminals 2*c* and 2*d* of the movable contact member 2 and the terminals 4*c* and 4*d* of the stationary contact member 4 are L-shaped to be inserted into the printed circuit board 102.

Figure 5:
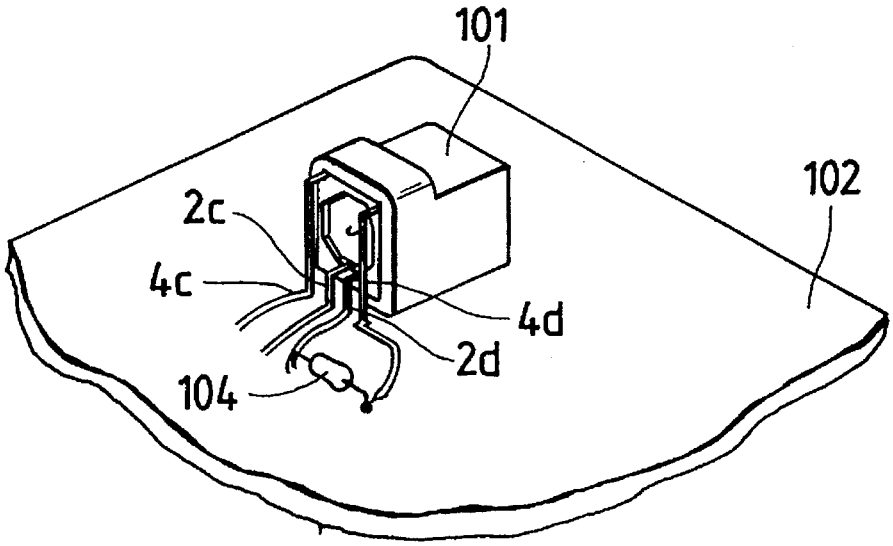
FIG. 5 is a perspective view which shows the collision detecting apparatus mounted on the printed circuit board, as illustrated in FIG. 4.
Figure 6:
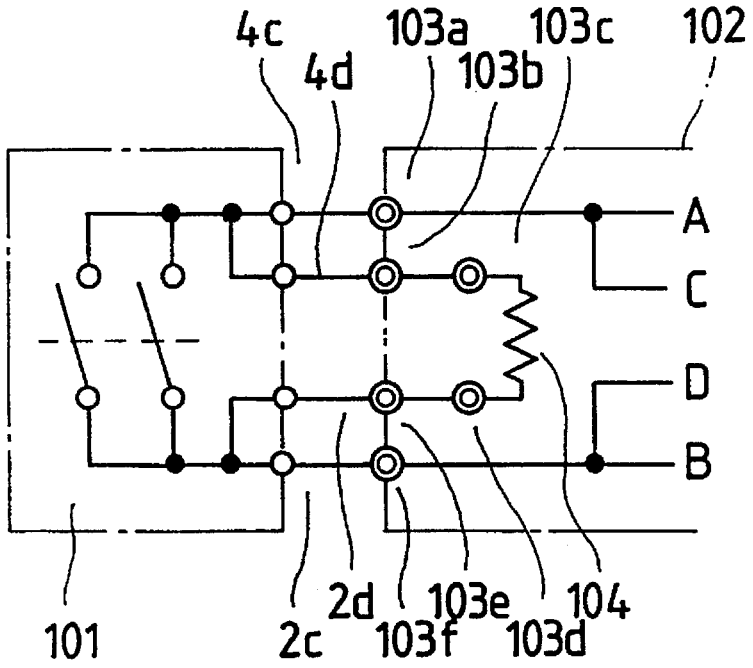
FIG. 6 is a circuit diagram of a collision detecting apparatus and an electronic control unit of an airbag safety unit.

FIG. 5 is a perspective view which shows the collision detecting unit 101 mounted on the printed circuit board 102 of the airbag electronic control unit. FIG. 6 shows a circuit diagram of the printed circuit board 102 and the collision detecting unit 101. In FIG. 6, the terminals 4*c* and 4*d* of the stationary contact member 4 connect with connection lands 103*a* and 103*b*, respectively. The terminals 2*d* and 2*c* of the movable contact member 2 connect with connection lands 103*e* and 103*f*, respectively. Between the connection lands 103*c* and 103*d*, a monitor resistance 104 is provided for monitoring a malfunction such as wire-breakage in an electrical circuit extending through the collision detecting unit 101 and the printed circuit board 102.

In operation, when a vehicle collides with an object, for example, another vehicle traveling ahead, it will produce acceleration acting on the mass member 6. The mass member 6 then slides along the outer surface of the shaft 5 in the left direction, as viewed in FIG. 3, against the spring force of the coil spring 7. The amount of the movement of the mass member 6 depends on the weight of the mass member 6, the spring constant K1 of the coil spring 7, and the spring constant K2 of the movable contact member 2. When the acceleration acting on the mass member 6 is greater than a preselected value so that the movement of the mass member 6 exceeds the contact gap S, as shown in FIG. 3, it will cause the movable contact member 2 to be returned to its closed position by virtue of elasticity thereof to engage the contacts 2*a* and 2*b* with the contacts 4*a* and 4*b* of the stationary contact member 4 to establish electrical communication therebetween. This allows current to flow from a battery (not shown) to a squib of the airbag safety unit to activate same.

When the impact caused by the vehicle collision is smaller than the preselected value, the mass member 6 cannot move over the contact gap S against the spring load of the spring 7. The airbag safety unit is not activated.

As clearly from the above discussion, according to the structure of the collision detecting unit 101 of this embodiment, assembling the unit is easily accomplished by mounting the movable contact member 2 having the reinforcing member 3 attached thereon, the stationary contact member 4, the shaft 5, the mass member 6, the coil spring 7, and the casing 8, in sequence, on the base support member 1 from the same direction (from left to right in FIG. 1). Therefore, it becomes possible to automatically assemble the collision detecting unit 101 in a simple manner.

In addition, the monitor resistance 104 is, as explained above, provided on the printed circuit board 102 which is disposed outside the unit 101, and thus may be mounted thereon in the same manner (e.g., using an automatic soldering device) as other circuit component parts to be mounted on the printed circuit board 102 for improving reliability of mounting as compared with installation in the casing 8 by welding, soldering, or crimping. Additionally, the arrangement of the monitor resistance 104 on the outside of the casing 8 facilitates the above described assembly of the component parts on the base support member 1 from one direction.

Further, the terminal 2*c* of the movable contact member 2 and the terminal 4*c* of the stationary contact member 4, as can be seen in FIG. 6, are connected to terminals A and B of a power circuit for the squib of the airbag safety unit and terminals C and D of a malfunction monitoring system for the collision detecting unit 101. Therefore, a circuit line of the collision detecting unit 101 extends, in series, from the squib power terminal A to the terminal B through the collision detecting unit-connection land 103*a* of the printed circuit board 102, the terminals 4*c* and 4*d* of the stationary contact member 4, the connection land 103*b*, the monitor resistance connection land 103*c*, the monitor resistance 104, the connection land 103*d*, the collision detecting unit-connection land 103*e*, the terminals 2*b* and 2*c* of the movable contact member 2, and the connection land 103*f*. Accordingly, as long as there is at least one disconnection in the circuit, it may be monitored through the terminals C and D.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A collision detecting apparatus comprising:

a spring;

a mass member biased by said spring in a given direction, said mass member receiving acceleration generated upon occurrence of a vehicle collision to move against a spring force of said spring;

a casing having disposed therein said mass member and said spring, said casing having a stopper member formed thereon for restricting movement of said mass member in said given direction biased by said spring;

a stationary contact member made of a single member, said stationary contact member having a stationary contact formed substantial on an end, the other end thereof extending outside said casing; and a movable contact member made of a single member, said movable contact member having a movable contact formed substantially on an end and the other end thereof extending outside said casing, said movable contact member being held at a given contact gap away from said stationary contact member by said mass member in engagement with the stopper member, and said movable contact member being located between said mass member and said stopper member.

2. A collision detecting apparatus as set forth in claim 1, wherein said movable contact member is made of an elastic member, when sad mass member moves against the spring force of said spring, said movable contact contacting the stationary contact by virtue of elasticity of said movable contact member.

3. A collision detecting apparatus as set forth in claim 2, wherein said movable contact member and said stationary contact member are each made of a conductive member.

4. A collision detecting apparatus as set forth in claim 3, wherein the other ends of said movable contact member and said stationary contact member extending outside said casing are bifurcated as external connections, respectively, a monitor resistance being arranged between one of the external connections of said movable contact member and one of the external connections of said stationary contact member to determine whether wire-breakage has occurred or not in an electric circuit line extending through said movable contact member and said stationary contact member in said casing.

5. A collision detecting apparatus as set forth in claim 3, wherein said movable contact member and said stationary contact member are bifurcated at least inside said casing to form a plurality of movable contacts and a plurality of stationary contacts thereon, respectively, when said mass member moves against the spring force of said spring, the movable contacts contacting the stationary contacts.

6. A collision detecting apparatus as set forth in claim 1, further comprising a bar member having both ends thereof retained by said casing, said bar member defining a given path of travel along which said mass member moves in response to the acceleration caused by the vehicle collision.

7. A collision detecting apparatus as set forth in claim 1, wherein said mass member is held between the stopper member and an inner surface of said casing on which the stopper member is formed in engagement with the stopper member.

8. A collision detecting apparatus as set forth in claim 1, wherein said mass member is a preselected weight, said spring force has a preselected spring force, and said movable contact member has a preselected degree of elasticity.

9. A collision detecting apparatus comprising:

a casing having an end wall and an opening oriented opposite the end wall;

a spring disposed in said casing;

a mass member, having a preselected mass, arranged in said casing to be biased by said spring in a first direction toward the opening of said casing along a given path of travel extending between the end wall and the opening to urge a movable contact into disengagement from a stationary contact, said mass member being responsive to acceleration, caused by impact acting on the apparatus, greater than a preselected level to move in a second direction opposite the first direction along the given path of travel against a spring force exerted by said spring to engage the movable contact with the stationary contact;

a base support member fitted into the opening of said casing and having a stopper member formed thereon for restricting movement of said mass member along the given path of travel in the first direction biased by said spring;

a movable contact member, made of an elastic member having a preselected degree of elasticity, having said movable contact formed on an end and the other end thereof extending in said first direction through said base support member, said movable contact member including a portion continuing the movable contact which traverses a contact surface of said mass member with the stopper member; and a stationary contact member having said stationary contact formed on an end and the other end thereof extending in said first direction through said base support member, said stationary contact member being retained by said casing so as to have the stationary contact face the movable contact with a given contact gap.

10. A collision detecting apparatus as set forth in claim 9, wherein said movable contact is disposed between said mass member and said stopper member so as to partially extend outside said mass member for engagement with or disengagement from the stationary contact.

11. A collision detecting apparatus as set forth in claim 9, wherein said movable contact member and said stationary contact member include terminals, respectively, which extend outside said base support member, and further comprising a resistance monitor provided between said terminals.

12. A collision detecting apparatus comprising:

a spring;

a mass member biased by said spring in a given direction, said mass member receiving acceleration generated upon occurrence of a vehicle collision to move against a spring force of said spring;

a tubular casing having an axis and having disposed therein said mass member and said spring, said casing having a stopper member formed thereon for restricting movement of said mass member in said given direction biased by said spring and said tubular casing having an opening and a base support member fitted into said opening of said casing, wherein said stopper member is located on said base support member and said stopper member restricts movement of said mass member parallel to said axis;

a stationary contact member made of a single member, said stationary contact member having a stationary contact formed substantially on an end, the other end thereof extending outside said casing; and a movable contact member made of a single member, said movable contact member having a movable contact formed substantially on an end and the other end thereof extending outside said casing, said movable contact member being held at a given contact gap away from said stationary contact member by said mass member in engagement with the stopper member, and said movable contact member being located between said mass member and said stopper member.

13. A collision detecting apparatus as set forth in claim 12, wherein said movable contact member extends through said base support member.

14. A collision detecting apparatus as set forth in claim 12, wherein said stationary contact member extends through said base support member.

* * * * *